United States Patent [19]

Davis et al.

[11] Patent Number: 4,969,074

[45] Date of Patent: Nov. 6, 1990

[54] TIER LIGHT INCLUDING DEFLECTING AND REFRACTING PRISMS

[75] Inventors: August Davis, Mundelein, Ill.; Ronald L. Sitzema, Ellsworth, Mich.

[73] Assignee: Intermatic Inc., Spring Grove, Ill.

[21] Appl. No.: 304,360

[22] Filed: Jan. 30, 1989

[51] Int. Cl.[5] ..... F21V 13/04

[52] U.S. Cl. ..... 362/327; 362/334; 362/363

[58] Field of Search ..... 362/367, 363, 327, 325, 362/302, 304, 310, 342, 354, 299, 300, 333, 334

[56] References Cited

U.S. PATENT DOCUMENTS

| | | | |
|---|---|---|---|
| 122,409 | 1/1872 | Skelton . | |
| D. 263,340 | 3/1982 | Budnovitch et al. . | |
| D. 284,312 | 6/1986 | Patel . | |
| 380,056 | 6/1906 | Hogan . | |
| 563,836 | 7/1896 | Blondel et al. . | |
| 736,535 | 8/1903 | Mygatt . | |
| 804,254 | 11/1905 | Mygatt . | |
| 821,307 | 5/1906 | Mygatt . | |
| 1,318,120 | 8/1931 | Doane . | |
| 2,456,166 | 12/1948 | Arenberg . | |
| 2,499,580 | 3/1950 | Hamel | 362/334 |
| 3,395,273 | 7/1968 | Welty | 362/334 |
| 3,433,941 | 3/1969 | Hall . | |
| 3,593,014 | 7/1971 | Vesely | 362/309 |
| 3,679,889 | 7/1972 | Franck . | |
| 3,697,740 | 10/1972 | Breed et al. . | |
| 3,705,303 | 12/1972 | Willis, Jr. et al. . | |
| 4,041,306 | 8/1977 | Compton et al. . | |
| 4,081,667 | 3/1978 | Lewin et al. . | |
| 4,434,455 | 2/1984 | Merritt | 362/363 |
| 4,719,548 | 1/1988 | Orose | 362/363 |

*Primary Examiner*—Ira S. Lazarus
*Assistant Examiner*—Richard R. Cole
*Attorney, Agent, or Firm*—Willian Brinks Olds Hofer Gilson & Lione

[57] ABSTRACT

A tier light comprising a lamp, a substantially clear lamp housing having an upper end and a lower end, a plurality of baffles on the housing and spaced apart along the housing to prevent generally horizontal emissions of light through the housing, and a reflector system. The reflector system comprises refracting means on the housing lower end for refracting light passing through the housing generally dominantly.

7 Claims, 3 Drawing Sheets

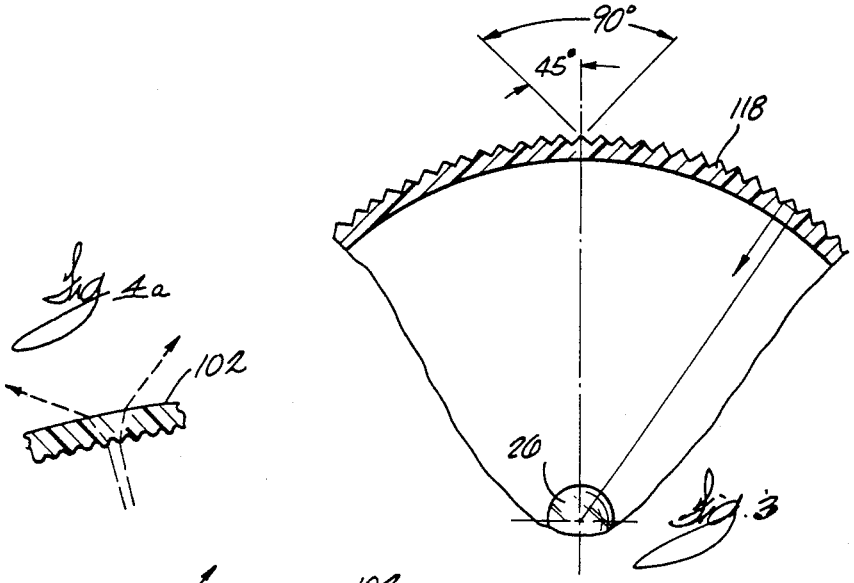
Fig. 3
Fig. 4a
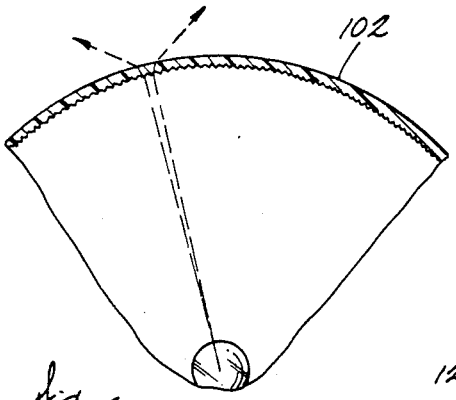
Fig. 4
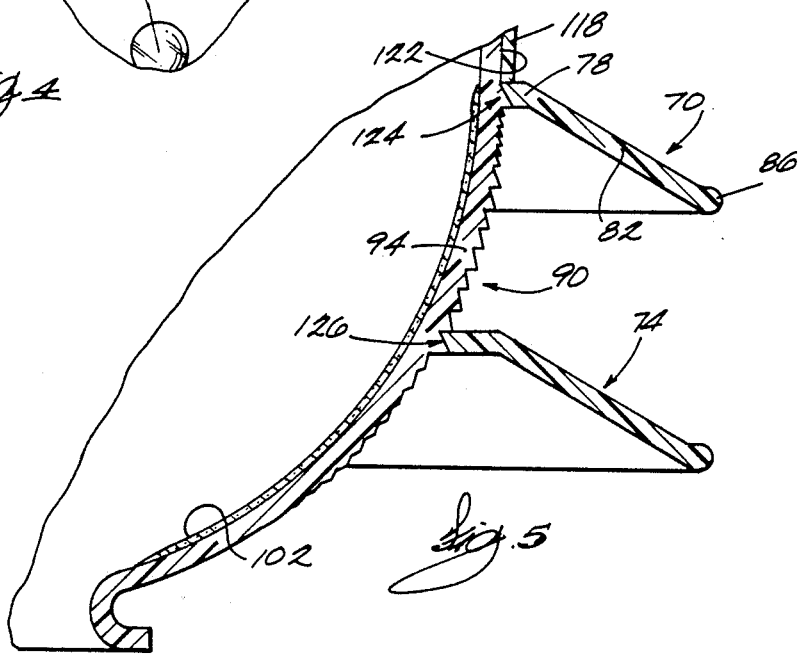
Fig. 5

TIER LIGHT INCLUDING DEFLECTING AND REFRACTING PRISMS

BACKGROUND OF THE INVENTION

The present invention relates to lamp housing constructions and, more particularly, to lamp housings for low voltage residential lighting tier lights. Even more particularly, this invention relates to means for improving the illumination from low voltage residential lighting tier lights. Low voltage lights as used herein refer to about twelve volt lights.

Various known baffle and optic systems have been built for tier lighting. Most are very inefficient and consume considerable energy and also cast little light onto the ground, terrain or articles that they are presumed to illuminate. The conventional tier light provides external baffles to hide the lamp but does not provide any vertical control of the light other than by the baffles themselves. Control of the light output was not considered to be feasible because the lamp housings have vertical walls, the attachment of the baffles to the lamp housing makes variations in the housing difficult, and the difficulty in providing any reflector into the top of the tier roof. The absence of a reflector in the tier roof causes 12% to 20% of the total lamp output to be wasted.

Attention is directed to Blondel et al. U.S. Pat. No. 563,836, issued July 14, 1896, which discloses a prismatic lamp housing.

SUMMARY OF THE INVENTION

Disclosed is a light comprising a lamp, a substantially clear lamp housing having an upper end and a lower end, and a reflector system comprising refracting means on the housing lower end for refracting substantially all of the light passing through the housing generally downwardly.

Also disclosed is a tier light comprising a lamp, a substantially clear lamp housing having an upper end and a lower end, a plurality of baffles on the housing and spaced apart along the housing to prevent generally horizontal emissions of light through the housing, and a reflector system. The reflector comprises refracting means on the housing lower end for refracting substantially all of the light passing through the housing generally downwardly.

In one embodiment, the tier light further includes reflecting means on the housing upper end for reflecting light back into the lamp housing, and diffusion means on the housing for diffusing light passing through the housing.

In one embodiment, the diffusion means comprises diffusion prisms on the interior of the housing. The reflecting means comprises reflecting prisms on the housing upper end, and the refracting means comprises refracting prisms on the exterior of the housing. The refracting prisms refract light passing through the housing generally downwardly.

It is one of the principal objects of the invention to provide a device that has an unique optical system adapted to use a broad range of low voltage, wedge base, incandescent lamps and shapes.

It is a further object of the invention to provide a reflector system capable of utilizing the 12% to 20% of the wasted light trapped in the top of conventional tier lights.

It is a further object of the invention to provide a tier light which uses baffles to minimize the direct or horizontal lamp brightness, but which also provides a means for directing light onto the ground, without having the light absorbed by the baffle materials.

It is another object of the invention that light be directed downwardly, thereby minimizing the amount of stray light, providing uniform illumination of the ground, reducing the apparent image of the lamp filament, and reducing light pollution to the surrounding area.

Various other objects and features of the invention are set forth in the following brief description of the drawings, the description of the preferred embodiments, and the appended claims.

BRIEF DESCRIPTION OF THE DRAWINGS

FIG. 3 is an enlarged partial view of the internal reflective prisms of the tier light shown in FIG. 3, showing how light is reflected by the prisms.

FIG. 4 and FIG. 4*a* are enlarged partial views of the internal diffusion prisms shown in FIG. 3, showing how light is diffused by the prisms.

FIG. 5 is an enlarged partial view of a portion of the refracting prisms which refract light rays generally downwardly. This view also shows the attachment of the baffles to the lamp housing.

DESCRIPTION OF PREFERRED EMBODIMENTS OF THE INVENTION

Figure 1:
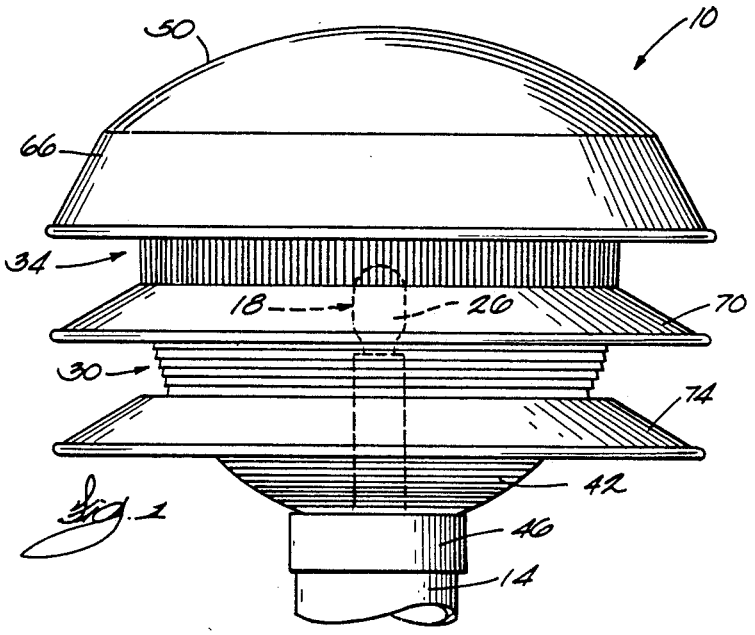
FIG. 1 is a side view of a tier light which embodiments various features of the invention.
Figure 2:
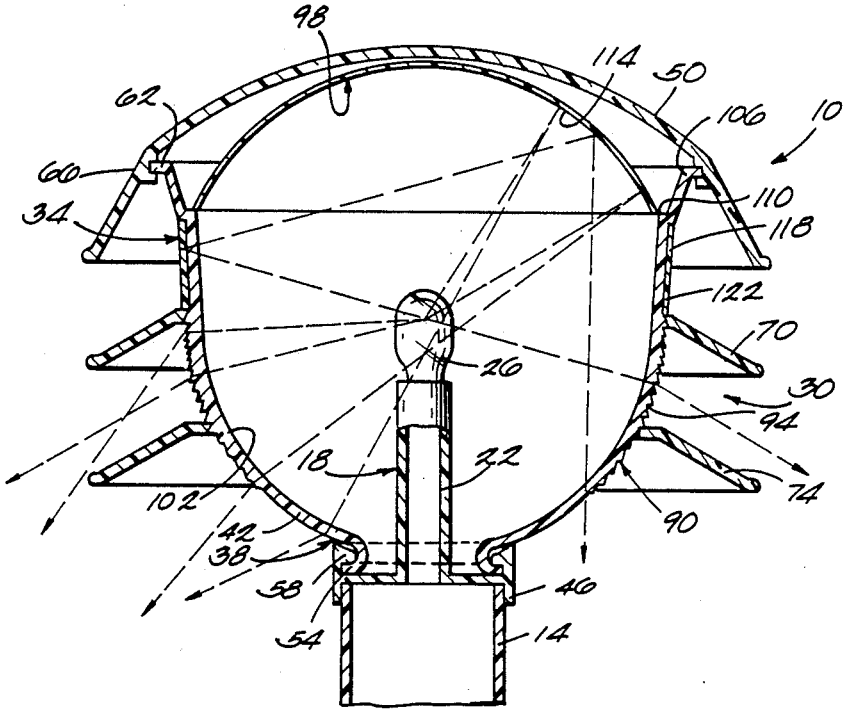
FIG. 2 is a cross sectional view of the tier light shown in FIG. 1.

FIGS. 1 and 2 illustrate a tier light 10. The tier light 10 is mounted on the top of a post 14. Secured in the end of the post 14 is a lamp 18. The lamp 18 includes a lamp socket 22, and a bulb 26. Any bulb may be used, but a low voltage wedge based incandescent bulb is preferred.

The tier light 10 further includes a substantially clear lamp housing 30 having an upper end 34, and a lower end 38. More particularly, the lamp housing 30 includes a substantially clear prismatic bowl 42, a lower housing mounting flange 46, and a housing cap 50. The lower housing mounting flange 46 is secured to the top of the post 14, adjacent the lamp socket 22. The prismatic bowl 42 includes four twist locking tabs 54, which cooperate with tab receiving pieces 58 on the mounting flange 46. When the bowl lower end 38 is placed within the mounting flange 46, and then twisted, the tabs 54 are received by the receiving pieces 58, and the bowl 42 is held on the post 14.

The substantially clear prismatic bowl 42 is a molded construction, made using conventional molding techniques. In the preferred embodiment, the bowl 42 is made of a light transmitting synthetic resin material.

The bowl upper end 34 also includes four twist lock tabs 62 which cooperate with four receiving pieces 66 on the housing cap 50. The housing cap 50 is placed on top of the bowl 42, and then twisted in order to lock the housing cap 50 on the prismatic bowl 42.

The tier light 10 further includes a plurality of baffles on the housing 30. The baffles are spaced apart along the housing 30 to prevent generally horizontal emissions of light from passing through the housing 30. More particularly, the tier light 10 includes an upper baffle 70 and a lower baffle 74 mounted at spaced positions on the prismatic bowl 42. Although other designs can be used in other embodiments, in this embodiment, the baffles (see FIG. 5) have an inner generally horizontal portion 78, a downwardly depending portion 82, and then an outer generally horizontal portion 86.

The tier light 10 further includes a reflector system 90. The reflector system 90 includes refracting means 94 on the housing lower end 38 for refracting substantially all of the light passing through the housing 30 generally downwardly, reflecting means 98 on the housing upper end 34 for reflecting light back into the lamp housing, and diffusion means 102 on the housing 30 for diffusing light passing through the housing 30.

More particularly, the bowl 42 has, as illustrated in FIG. 2, a decorative outwardly extending flange 106 at the top thereof. At the base of the outwardly extending top flange 106 is a stop 110 which supports the reflecting means 98 which comprises a semi-spherical member in the form of a laminated metalized film reflector 114. The inner surface of the metalized film reflector 114 serves to reflect light from the bulb 26 back into the remainder of the prismatic bowl 42. The reflecting means 98 further includes a band of internal reflective prisms 118 present on a strip supported around the bowl upper end 34. More particularly, the bowl upper end 34 includes an indented portion 122 which receives the band of internal reflective prisms 118.

As illustrated in FIG. 3, the internal reflective prisms 118 generally reflect light from the bowl back towards the inside of the prismatic bowl 42.

As illustrated in FIG. 4, the diffusion means is in the form of diffusion prisms 102 present on the interior of the prismatic bowl 42 below the indentation portion 122 which receives the internal reflective prisms 118. The internal diffusion prisms 118 generally serve to bend light passing through the prisms in order to diffuse or spread out the light. This gives the prismatic bowl 42 the appearance of a white opaque cylinder without creating the significantly loss in efficiency which occurs with white opaque cylinders.

The refracting means is in the form of refracting prisms 94, as generally illustrated in FIG. 5. The refracting prisms 94 are generally triangular in shape and increasing in size from near the upper baffle 70, down to the lower baffle 74. Below the lower baffle 74, the refracting prisms 94 gradually decrease in size. The generally triangular shaped prisms 94 serve to generally direct the light emissions passing through the prismatic bowl 42 in a generally downwardly direction. In other embodiments of the invention, other refracting prism shapes may be used in order to obtain other light patterns.

Different light patterns may be selected in order to provide for the most effective use of the light for walkways, bikeways or ground lighting in general.

In the preferred embodiment, the upper baffle 70 is shrunk-to-fit on a first triangular piece 124 of the prismatic bowl 42. The upper baffle 70 is held in place on the first triangular piece 124 by the reflective prism band 118 which is positioned above the upper baffle 70. The lower baffle 74 is shrunk-to-fit on a second triangular piece 126 of the prismatic bowl 42, and is held in place on the second triangular piece 126 by the lower surface of the next above refracting prism 94. Other methods of attaching baffles to the lamp housing 30 may be used in other embodiments.

A comparison was made of the illumination characteristics of the tier light 10 with a comparable tier light having a white cylindrical bowl without either refective means or refractive means. The test cell was positioned at various distances from the light at thirteen inches below the light.

| Distance (inches) | Illumination (footcandles) | |
|---|---|---|
| | Clear Prismatic | White Cylindrical |
| 6 | 4.32 | 1.29 |
| 12 | 3.71 | 1.08 |
| 18 | 2.62 | .76 |
| 24 | 1.77 | .52 |
| 30 | .68 | .34 |
| 36 | .20 | .24 |

Figure 6A:
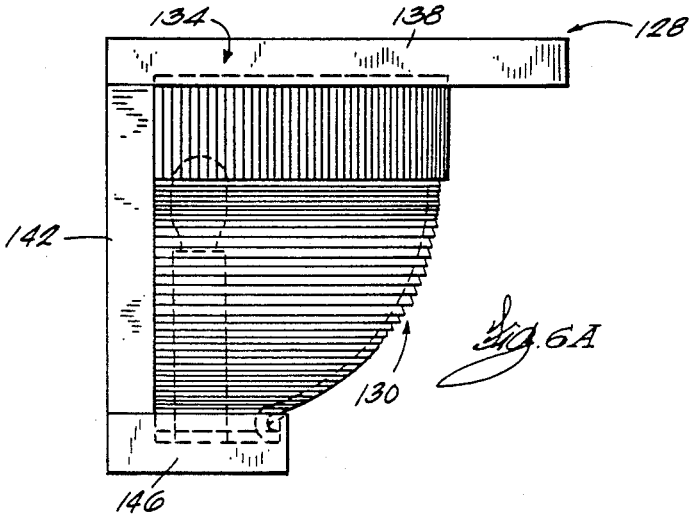
FIGS. 6A, 6B, and 6C are side, front and cross sectional views, respectively, of another embodiment of the invention.
Figure 6B:
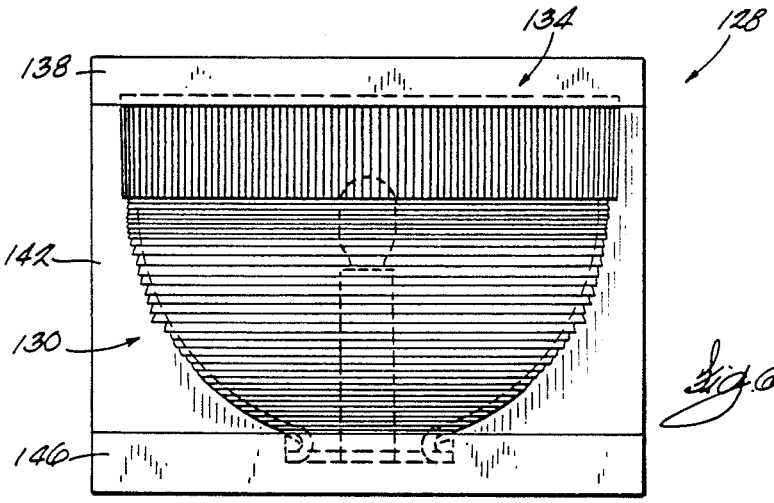
Figure 6C:
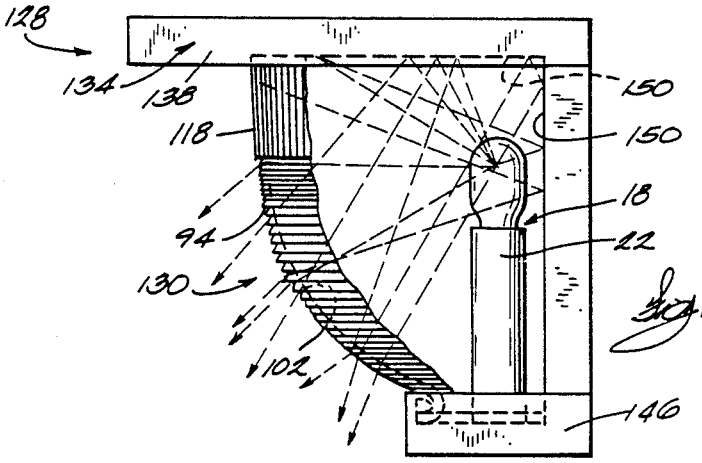

An alternate embodiment of the tier light 10, suitable for us as a wall light 128, is illustrated in FIGS. 6A, 6B, and 6C. Like numerals have been used for components found in the above described embodiment.

In this embodiment, the lamp housing 130 is in the shape of a quarter sphere. The lamp housing 130 is held in a holder 134 adapted to be mounted on a wall (not shown). The holder 134 has a horizontal top 138, an vertical back 142, and a lower mounting flange 146. The three pieces are positioned around the lamp housing 130, and then secured together to hold the lamp housing 130 in place.

In this embodiment, a reflective film 150 is applied to the holder top 138 and holder back 142 within the lamp housing 130 so as to reflect light back into the prismatic bowl.

Various other features of the invention are set forth in the following claims.

We claim:

1. A light comprising a lamp, a substantially clear lamp housing having an upper end and a lower end, said housing including diffusion means for diffusing light passing through said housing, and a reflector system comprising refracting means on said housing lower end for refracting substantially all of the light passing through said housing generally downwardly, and reflecting means on said housing upper end for reflecting the light back into said lamp housing, said reflecting means comprising a reflecting member at the upper end of the housing, and a band mounted on the upper end of the housing and including internal reflective prisms.

2. A light in accordance with claim 1 where said diffusion means comprises diffusion prisms on the interior of the lower end of the housing.

3. A light in accordance with claim 1, wherein said refracting means comprises refracting prisms on the exterior of the lower end of said housing.

4. A tier light comprising a lamp, a substantially clear lamp housing having an upper end and a lower end, a plurality of baffles on said housing and spaced apart along said housing to prevent generally horizontal emissions of light through said housing, reflecting means comprising a semi-spherical reflecting member at the upper end of the housing, and a band mounted on the upper end of the housing and including internal reflective prisms, and a reflector system comprising refracting means on said housing lower end for refracting substantially all of the light passing through said housing generally downwardly.

5. A tier light in accordance with claim 4, and further including diffusion means on said housing for diffusing light passing through said housing.

6. A tier light in accordance with claim 5, wherein said diffusion means comprises diffusion prisms on the interior of the lower end of the housing.

7. A tier light in accordance with claim 4, wherein said refracting means comprises refracting prisms on the exterior of the lower end of said housing.

* * * * *